United States Patent [19]

Komarneni et al.

[11] Patent Number: 4,808,318

[45] Date of Patent: Feb. 28, 1989

[54] PROCESS FOR CESIUM DECONTAMINATION AND IMMOBILIZATION

[75] Inventors: Sridhar Komarneni, Altoona; Rustum Roy, State College, both of Pa.

[73] Assignee: The United States of America as represented by the United States Department of Energy, Washington, D.C.

[21] Appl. No.: 185,222

[22] Filed: Apr. 25, 1988

[51] Int. Cl.[4] ..... G21F 9/12; G21F 9/16

[52] U.S. Cl. ..... 210/682; 210/751; 252/628; 252/631

[58] Field of Search ..... 210/682, 751; 252/628, 252/631

[56] References Cited

U.S. PATENT DOCUMENTS

| | | | |
|---|---|---|---|
| 3,161,601 | 12/1964 | Barton | 252/301.1 |
| 3,428,568 | 2/1969 | Harker et al. | 252/631 |
| 4,537,710 | 8/1985 | Komarneni et al. | 252/628 |
| 4,737,316 | 4/1988 | Macedo et al. | 252/628 |

OTHER PUBLICATIONS

Scott et al., "Susceptibility of Interlayer Potassium in Micas to Exchange with Sodium", *Clays Clay Miner,* 14, 69 (1966).

Komarneni et al., "Low Temperature Materials for Waste Disposal" abstract of paper presented at Amer. Ceramic Soc. Meeting, Apr. 26, 1987.

Komarneni et al., "A Cesium-Selective Ion Sieve made by Topotactic Leaching of Phlogopite Mica" *Science,* 239, pp. 1286–1288, (1988).

Mercer et al., "Zeolite Ion Exchange in Radioactive and Municipal Wastewater Treatment" *Natural Zeolite Occurances, Properties, Use,* pp. 451–462, Pergamon Press (1978).

Temura, "Sorption Phenomena Significant in Radioactive-Waste Disposal", Am. Assoc. Pet. Geol. Mcm., 18, pp. 318–330 (1972).

Thompson et al., "Hydration States of an Expanded Phlogopite in Relation to Interlayer Cations", *Clay minerals,* pp. 43–49 (1967).

Wilson, "A Visit to Chernobyl" *Science,* 236, pp. 1636–1640, (1987).

Wallace et al., "Development of an Improved Ion-Exchange Process for Removing Cesium and Strontium from High-Level Radioactive Liquid Wastes" *Scientific Basis for Nuclear Waste Management,* vol. 3, pp. 75–77.

*Primary Examiner*—Ivars Cintins

*Attorney, Agent, or Firm*—Thomas G. Anderson; James W. Weinberger; Judson R. Hightower

[57] ABSTRACT

Cesium can be selectively recovered from a nuclear waste solution containing cesium together with other metal ions by contact with a modified phlogopite which is a hydrated, sodium phlogopite mica. Once the cesium has entered the modified phlogopite it is fixed and can be safely stored for long periods of time.

6 Claims, 3 Drawing Sheets

DEGREES TWO THETA (CuKα)

PROCESS FOR CESIUM DECONTAMINATION AND IMMOBILIZATION

CONTRACTUAL ORIGIN OF THE INVENTION

The U.S. Government has rights in this invention pursuant to Contract No. DE-FG02-85ER45204 between the U.S. Department of Energy and Pennsylvania State University.

BACKGROUND OF THE INVENTION

The invention relates to a method for immobilizing radioactive wastes for long term storage. More specifically, the invention relates to a method for recovering cesium from solutions containing cesium together with other metal values and for immobilizing radioactive cesium in a highly stable, nonvolatile and insoluble product suitable for long-term storage.

The principal long-term problem caused by nuclear reactor accidents is contamination of the environment with radioactive material as was evidenced by the Chernobyl nuclear reactor accident in 1986. Cesium is a particular problem in this respect because it is very volatile and can be carried in the upper atmosphere for long distances. Therefore, suitable methods of decontaminating the environment, i.e. water and soil, of cesium before its ingestion by animals or humans are highly desirable. Also desirable are methods for recovering radioactive cesium from the gastrointestinal tracts of contaminated animals.

Certain cation exchange resins and various cation exchangers are available which are selective for the recovery of cesium from solution. These include clay minerals and zeolites, both naturally occurring and synthetic. Furthermore, naturally occuring mordenite zeolite has been mixed with animal feed to remove ingested cesium-137 from the gastrointestinal tracts of contaminated animals. Other natural zeolites include clinoptilolite, erionite and chabazite.

In addition to recovering the ions, the radioactive ions must be immobilized in a form suitable for longterm storage so that they cannot be released back into the environment or leached from the storage medium into the surrounding soil or groundwater.

Many methods and materials have been developed over the years for immobilizing various nuclear wastes, and especially cesium, for long-term storage. For example, U.S. Pat. No. 3,161,601 dated Dec. 19, 1964, and assigned to the common assignee, incorporated the radioactive cesium into a glass containing cesium oxide, alumina, phosphate and an additive such as lanthanum or zirconium. Another method was to incorporate the cesium-137 as cesium carbonate with spodumene or with a mixture of silica and kaolin at a temperature of at least 1000° C. to form a synthetic pollucite. Another process mixed an inorganic zeolite containing radioactive cesium with about 20% additives, mainly iron and calcium oxides, which was melted at 1500° C. and control cooled to form an iron-enriched basalt. U.S. Pat. No. 4,537,710, also assigned to the common assignee, describes a cation exchanger which is a modified tobermorite containing aluminum, that is selective for a small number of ions including cesium. The advantage of the modified tobermorite is that it is compatable with matrix materials such as concrete and, therefore, more resistant to leaching.

Other, less satisfactory, methods involve incorporating the radioactive waste directly into a matrix material such as asphalt or concrete before emplacement for storage.

Almost all of the materials or processes suitable or selective for the separation and recovery of cesium from contaminated water or radioactive waste streams require additional processing to immobilize the cesium, in order to prevent the radioactive ions from being leached or otherwise separated from the storage medium. For example, the cesium ions may be eluted from the ion exchanger and incorporated directly into the matrix material for storage. Preferably, the recovery material (ion exchanger) containing the radioactive ions, is itself incorporated into the storage medium, such as a glass or cement, for storage. Alternatively, the radioactive ions may be mixed with other inorganic materials and by applying heat and/or pressure, formed into a synthetic mineral which is satisfactory for storage.

Thus, most processes require several steps to recover and prepare the cesium for storage. This increases the cost of preparing the radioactive ions for storage. Furthermore, some processes require high pressures and/or temperatures which in addition to increasing costs, increases the opportunities for the loss of radioactive material. Finally, many of the storage materials are not wholly suitable for long-term storage because leaching of the radioactive ions can occur.

SUMMARY OF THE INVENTION

It has been found that a modified phlogopite mica is very ion selective for cesium ions, even from solutions which also contain sodium and calcium ions. Furthermore, it has been found that the modified phlogopite mica will trap the cesium ions in such a manner that the phlogopite containing the cesium is suitable for emplacement for long-term storage, with little or no additional processing. The modified phlogopite mica of the invention is a phlogopite mica which has been hydrated and in which the potassium ions have been replaced by sodium ions. The invention is a process for the separation and recovery of cesium ions from a feed solution containing cesium ions, and which may contain other metal ions, by contacting the solution with the modified phlogopite which is a hydrated sodium phlogopite mica whereby the cesium ions are selectively taken up by the modified phlogopite while the other ions remain in the solution, and separating the modified phologopite containing the cesium ions from the feed solution thereby recovering the cesium ions. The invention is also a process for fixing radioactive cesium for long-term storage by contacting a solution containing radioactive cesium with the modified phlogopite which is a hydrated, sodium mica maintaining the contact until sufficient cesium is taken up by the modified phlogopite to reduce the c-axis spacing an amount sufficient to immobilize the cesium, thereby fixing the radioactive cesium ions for long-term storage. Alternatively, the cesium may be fixed by heating the modified phlogopite containing the cesium to a temperature sufficient and for a period of time sufficient to reduce the c-axis spacing thereby fixing the cesium ions in the modified phlogopite.

Since the modified phlogopite of the invention is very selective for cesium ions, it is especially useful for the recovery of radioactive cesium ions which are present in radioactive waste solutions along with other metallic ions including sodium and calcium. The solutions may be either low level, intermediate or high level nuclear wastes. It is also useful for the recovery of cesium-137 from large volumes of water containing low levels of cesium such as nuclear reactor coolant systems which have become contaminated because of fuel element ruptures or from stream or water supplies which have become contaminated due to $Cs^{137}$ fallout. Furthermore, because of its inertness and stability in an acidic environment, the modified phlogopite is suitable for ingestion by animals for the recovery and removal of ingested radioactive cesium fron the gastrointestinal tract, result from nuclear mishaps like the Chernobyl incident.

It is therefore one object of the invention to provide a process for recovering cesium.

It is another object of the invention to provide a process for recovery of cesium from solutions containing cesium together with other ions.

It is a further object of the invention to provide a process for fixing cesium for the long-term storage.

It is still another object of the invention to provide a one-step process for recovering and fixing cesium ions for long-term storage.

Finally, it is the object of the invention to provide a process for recovering and immobilizing radioactive cesium ions for long-term storage which does not require conditions of high temperature or high pressure.

DETAILED DESCRIPTION OF THE FIGURES

DETAILED DESCRIPTION OF THE PREFERRED EMBODIMENT

Figures 1, 2, 3:
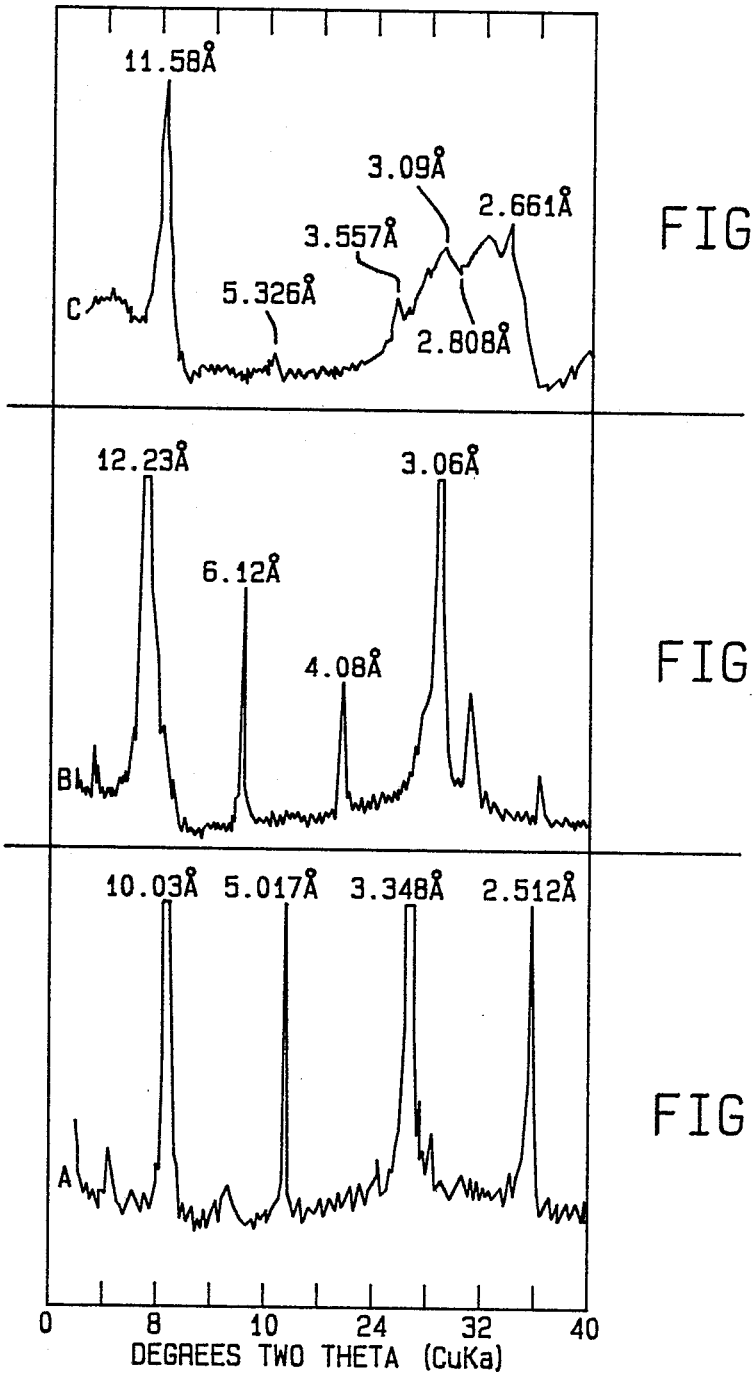
FIG. 1 is a x-ray diffractogram showing the c-axis spacing of untreated phlogopite mica.
FIG. 2 is a x-ray diffractogram showing the c-axis spacing of the modified phlogopite mica of the invention.
FIG. 3 is a x-ray diffractogram of the modified phlogopite mica of the invention saturated with cesium ions.

These and other objects of the invention for recovering and fixing radioactive cesium ions for long-term storage may be met by contacting a feed solution containing the cesium together with other metal ions with a hydrated sodium phlogopite mica which has a c-axis spacing of about 12.23Å, whereby the cesium is selectively absorbed by the modified phlogopite, maintaining said contact until sufficient cesium ions are absorbed to reduce the c-axis spacing to at least about 11.58Å, and separating the modified phlogopite containing cesium from the feed solution, thereby recovering the cesium ions from the solution and fixing the ions for long-term storage. Alternatively, the modified phlogopite containing the absorbed cesium ions can be heated to at least 150° C. for a period of time sufficient to dehydrate the modified phlogopite thus reducing the c-axis spacing and fixing the cesium ions for long-term storage.

The modified phlogopite is prepared by the method described in *Clays Clay Miner* 14, 69 (1966) incorporated herein by reference. As described therein, naturally occuring phlogopite mica, having the formula: $KMg_3Si_3AlO_{10}(OH)_2$ is finely ground to about 0.2 to 20 um particle size and contacted with a solution of about 1.0 N NaCl, 0.3 N sodium tetraphenylboron (NaTPB) and 0.01 M ethylenediamine-tetracetic acid (EDTA) for a period of several hours. This results in a complete depletion of $K^+$ ions from the interlayers of the phlogopite mica and the simultaneous saturation of the interlayers with $Na^+$ ions along with a monolayer of water molecules. This treatment results in a phase with 12.23Åc-axis (001) spacing as opposed to the original phlogopite mica which has a c-axis spacig of 10.03A. This 12.23Å phase is ideally $NaMg_3Si_3AlO_{10}(OH)_2 \cdot H_2O$ or hydrated sodium phlogopite.

Contact between the solution containing cesium ions may take place by passing the solution through a packed bed or column of the modified phlogopite. Alternatively, the modified phlogopite may be mixed with the solution containing the cesium ions and recovered by filtering.

The modified phlogopite is very selective for cesium ions and should be able to selectively recover cesium ions from the presence of any other metal ions.

The theoretical capacity of the modified phlogopite for cesium ions is about 210 meq/100g. However, the maximum cesium loading which can be attained is about 93.7 meq/100g at which loading a cesium sodium phlogopite mica is formed. This incomplete cesium exchange can be explained by the fact that the interlayer spacing significantly collapses to about 11.58Å when about half of the exchange sites are occupied by cesium. This collapse of the c-axis or interlayer spacing by about 0.65Å is effective in preventing any further exchange of cesium ions from solution. Therefore, just as the cesium ions cannot enter the structure after the initial exchange, the cesium ions that entered the structure cannot escape from the collapsed interlayers, effectively leading to the fixation of the cesium ions. The collapse of the interlayers is explained by dehydration of the ions in the interlayer because of the high charge density of the layers and the low hydration energy of the cesium ions.

Once the cesium ions have entered the phlogopite structure, they are fixed and not subject to displacement. However, collapse of the c-axis or interlayer structure and total fixation of the cesium is not believed to occur until the modified phlogopite contains about 80 meq of cesium. The spacing can be reduced and the mica formed when the cesium loading is less than about 80 meq by heating the cesium containing phlogopite to at least 150° C. for a period of time sufficient to partially dehydrate the phlogopite and reduce the c-axis spacing. Generally, a heating time of about an hour, depending on the size of the sample has been found sufficient. Since interlayer collapse is believed caused by dehydration, there is no minimum loading of cesium on the modified phlogopite before fixation can take place by heating. However, a modified phlogopite containing no cesium ions and only sodium ions will require higher temperatures before any dehydration can take place.

The following examples are given to illustrate the invention and are not to be taken as limiting the scope of the invention which is defined by the appended claims.

EXAMPLE I 5 grams of phlogopite mica was ground to a fine powder having a particle size ranging from about 0.2 to 20.0 um. 5 grams of this powder was contacted with 100 ml of an aoueous solution of about 1.0 N NaCl, 0.3 N sodium tetraphenylboron and 0.01 H ethylene-diamine tetraacetic acid for a period of 24–48 hours. The powder was removed from the solution, washed with water and acetone, dried and characterized by powder x-ray diffraction. The diffraction showed that the c-axis (001) spacing was 12.23Å, as shown in FIG. 2. This is compared to the original phogopite mica spacing of 10.03Å shown by FIG. 1.

EXAMPLE II

Figure 4:
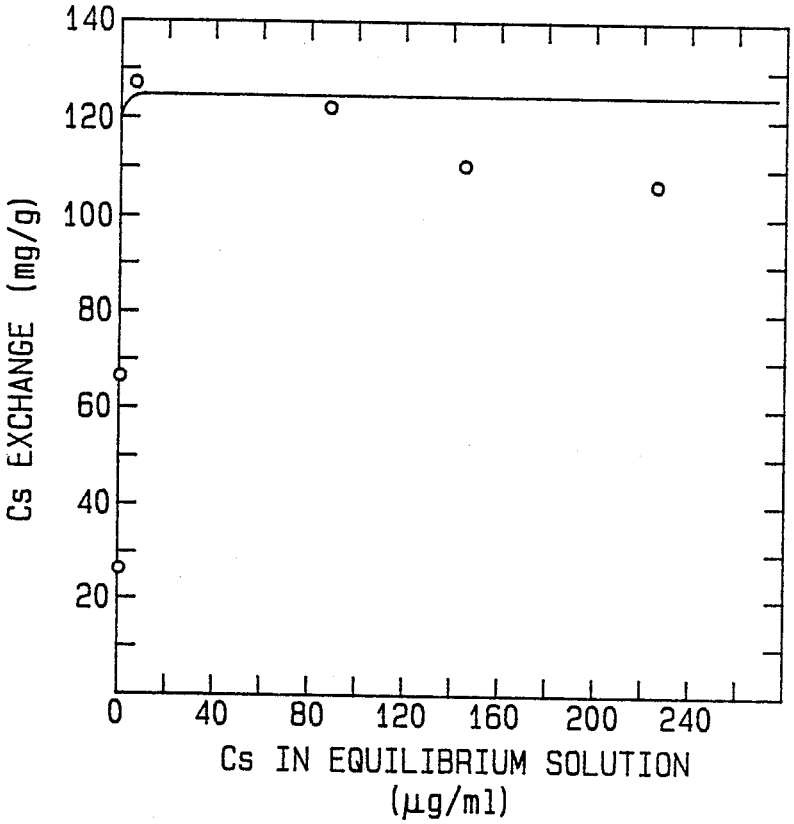
FIG. 4 is a graph of the cesium exchange isotherm of modified phlogopite in the presence of pure CsCl solutions.

A 0.015 gm sample of modified phlogopite of Example I was placed in 15 ml of a CsCl solution containing 26.5 mg Cs per ml for 4 days. The solid and solution phases were separated by centrifugation after equilibration. The solution was analyzed for $Cs^+$ by atomic absorption spectroscopy (AAS), and the solid phase was characterized by powder x-ray diffraction (XRD). In a similar manner, a number of tests were made with a constant solid solution ratio, but increasing amount of cesium. The cesium exchange solution of modified phlogopite in the presence of pure CsCl solutions showed that a steady state was attained at a cesium loading of 124.5 mq/gm which is the equivalent of 93.7 meq/100 g in the presence of $Na^+$ released from the interlayers during equilibration. The results are shown in FIG. 4. The K-depleted phlogopite mica has a theoretical exchange capacity of about 210 meq/100 g so that the cesium exchange that occured was incomplete.

EXAMPLE III

The cesium loaded philogopite of Example II was characterized by powder x-ray diffraction. FIG. 3 is a diffractogram which shows that the c-axis spacing decreased to 11.58Å from 12.23Å. Further examination shows that cesium mica has formed as revealed by the 10.65Åc-axis spacing that can be derived from the d(002), d(003) and d(004) spacings of 5.326Å, 3.557Å and 2.661Å respectively.

EXAMPLE IV 0.020 gms of the modified phlogoplte as prepared in Example I was contacted with a solution containing 25 ml containing 0.0002 M CsCl, 0.01 M $CaCl_2$ and 0.04 M $NaNO_3$ to determining the selectivity of the phlogopite for cesium ions in the presence of excess $Na^+$ and $Ca^{++}$ ions. In a similar manner, like quantities of other cation exchangers known to have an affinity for cesium ions were also tried. The results are shown in Table I.

TABLE I

| Sample | Cesium exchange, $K_d$(ml/g) 0.01 M $CaCl_2$ | 0.04 M $NaNO_3$ |
|---|---|---|
| K-depleted phlogopite mica | 664,000 | 949,000 |
| gamma-zirconium phosphate | 27,700 | 16,000 |
| Mordenite, Nevada | 165,000 | 4,300 |
| Phillipsite, Nevada | 34,500 | 9,800 |
| Clinoptilolite, California | 16,600 | 4,400 |

As shown in the Table, the selectivity of the modified phlogopite is much higher than that of the other cation exchangers used for cesium recovery.

EXAMPLE V 0.010 gm of the modified phlogopite containg varying amounts of cesium was placed in a solution composed of 10 ml of solution consisting of 0.005 M $CaCl_2$, 0.001 M $MgCl_2$, 0.00025 M KCl and 0.001 M NaCl, which are the ions most abundant in natural waters. The phlogopite was allowed to soak for 24 hours before being removed by centrifugation, and dried. The solution was then analyzed by atomic absorption spectroscopy. The results are shown in Table II below.

TABLE II

| Initial amount of Cs exchanged, meq/100 g | Amount of Cs released, meq/100 g | Percentage of Cs released |
|---|---|---|
| 84.4 | 0.053 | 0.06 |
| 80.7 | 0.068 | 0.08 |
| 50.0 | 0.045 | 0.09 |
| 19.9 | 0.038 | 0.19 |

As shown by the Table, very little cesium was released. Even the small amounts released appear to have been displaced from the external surfaces because the modified phlogopite has an exchange capacity of about 3 to 4 meq/100 g on the surface. Thus, all the cesium that entered the interlayers of modified phlogopite and most of the surface exchanged cesium was not released by the above treatment. This data clearly shows that the cesium has been immobilized by the modified phlogopite at room temperature without any additional treatment.

Figure 5:
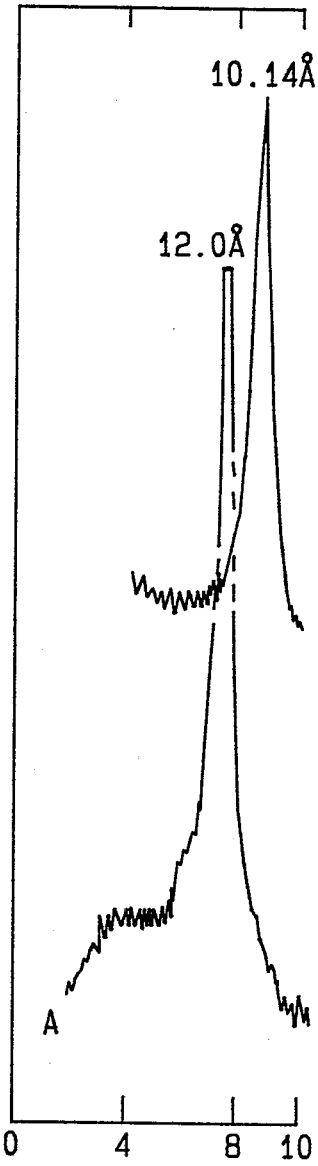
FIG. 5 is a diffractogram showing the c-axis spacing of modified phlogopite containing 50 meq/100 gm cesium ions before and after heating.
Figure 6:
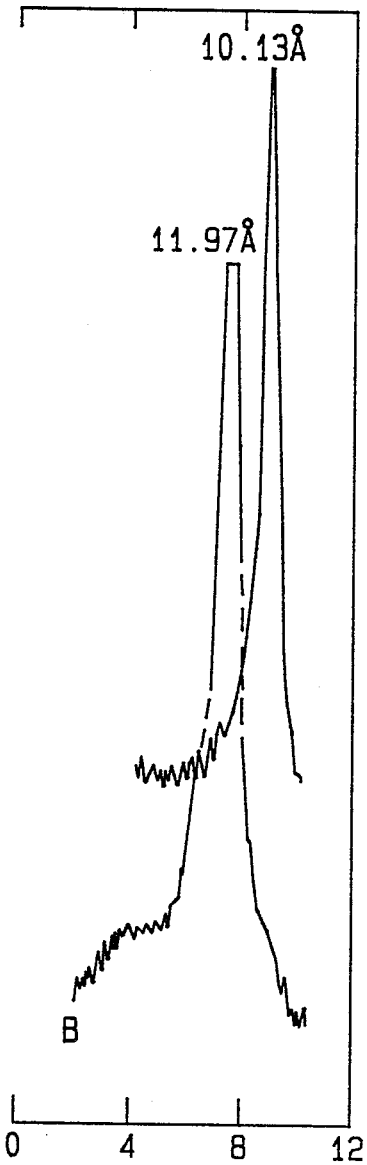
FIG. 6 is a diffractogram showing the c-axis spacing of a modified phlogopite containing 19 meq/100 gm cesium ions before and after heating.

EXAMPLE VI 0.15 grams of modified phlogopite containing about 50 meq cesium as heated to about 200° C. for one hour in order to fix the cesium within the intelayer. The results of a powder x-ray diffraction are shown in FIG. 5 superimposed on an unheated sample. In a like manner, 0.015 gm sample o modified phlogopite containing 19.9 meq cesium/100 grams was also heated. The results are shown in FIG. 6, also superimposed on an unheated sample. The diffractograms show that the heat treatment at only 200° C. for one hour decreased the c-axis spacing to 10.13–10.14Å from about 12.0Å. This decrease of the c-axis spacing is a result of the dehydration and collapse of the interlayers and thus trapping cesium.

As can he seen from the above described specification and examples, the invention for the recovery and storage of cesium in a hydrated, sodium phlogopite mica provide a suitable new material for the decontamination, fixation and long-term storage of cesium.

The embodiments of the invention in which an exclusive property or privilege is claimed are defined as follows:

1. A process for separating and recovering cesium ions from a feed solution comprising:
   contacting the feed solution containing cesium together with other metal ions with a modified phlogopite which is a hydrated, sodium phlogopite mica whereby the cesium ions are selectively taken up by the modified phlogopite, and separating the phlogopite containing the cesium ions from the feed solution, thereby recovering the cesium ions.

2. The process of claim 1 wherein the feed solution also contains sodium and calcium ions.

3. The process of claim 2 wherein the modified phlogopite mica has a c-axis spacing of about 12.23Å.

4. A method of recovering and fixing radioactive cesium ions contained in a liquid waste feed solution for long-term storage comprising:
   contacting the liquid waste with a modified phlogopite which is a hydrated sodium phlogopite mica having a c-axis spacing of about 12.23Å whereby the cesium ions are selectively taken up by the modified phlogopite, and reducing the c-axis spacing an amount sufficient to lock-in the cesium ions, thereby immobilizing the cesium ions for long-term storage.

5. The method of claim 4 wherein sufficient cesium ions are taken up by the modified phlogopite to reduce the c-axis spacing.

6. The method of claim 4 wherein the cesium-containing phlogopite is heated to about 150° C. for a period of time sufficient to reduce the c-axis spacing.

* * * * *